US008291880B2

(12) United States Patent
Häfner et al.

(10) Patent No.: US 8,291,880 B2
(45) Date of Patent: Oct. 23, 2012

(54) INTERNAL COMBUSTION ENGINE COMPRISING SEVERAL COMBUSTION CHAMBERS

(75) Inventors: Jochen Häfner, Lorch (DE); Dieter Nowak, Weilheim (DE)

(73) Assignee: Daimler AG, Stuttgart (DE)

( * ) Notice: Subject to any disclaimer, the term of this patent is extended or adjusted under 35 U.S.C. 154(b) by 520 days.

(21) Appl. No.: 12/583,011

(22) Filed: Aug. 12, 2009

(65) Prior Publication Data

US 2010/0037847 A1 Feb. 18, 2010

Related U.S. Application Data

(63) Continuation-in-part of application No. PCT/EP2008/000799, filed on Feb. 1, 2008.

(30) Foreign Application Priority Data

Feb. 16, 2007 (DE) ..... 10 2007 007 638

(51) Int. Cl.
*F02F 1/42* (2006.01)

(52) U.S. Cl. ..... 123/193.5; 123/193.3; 60/313; 60/314; 60/315; 60/316; 60/317; 60/318; 60/319; 60/320; 60/321; 60/322; 60/323

(58) Field of Classification Search ..... 123/193.3, 123/193.5; 60/313–323
See application file for complete search history.

(56) References Cited

U.S. PATENT DOCUMENTS

| | | | | |
|---|---|---|---|---|
| 4,537,027 | A * | 8/1985 | Harwood et al. | 60/323 |
| 4,777,708 | A * | 10/1988 | Harwood et al. | 29/890.08 |
| 4,850,189 | A * | 7/1989 | Arthur et al. | 60/323 |
| 5,729,975 | A * | 3/1998 | Bekkering | 60/323 |
| 6,474,697 | B2 * | 11/2002 | Nording et al. | 285/179 |
| 6,604,358 | B2 * | 8/2003 | Durr et al. | 60/323 |
| 7,849,683 | B2 * | 12/2010 | Asame et al. | 60/323 |
| 2005/0193726 | A1 * | 9/2005 | Funakoshi | 60/323 |

FOREIGN PATENT DOCUMENTS

| | | |
|---|---|---|
| DE | 405695 | 11/1924 |
| DE | 26 45 120 | 4/1977 |
| DE | 31 13 251 | 10/1982 |
| DE | 101 41 534 | 6/2002 |
| GB | 2 141 174 | 12/1984 |
| JP | 54-079317 | 6/1979 |
| JP | 54 079317 | 6/1979 |
| JP | 62 099612 | 5/1987 |
| JP | 08-334017 | 12/1996 |
| JP | 09 032544 | 2/1997 |
| JP | 9-032544 | 2/1997 |
| JP | 09 242542 | 9/1997 |
| JP | 10 266845 | 10/1998 |
| JP | 2005-076605 | 3/2005 |
| JP | 2009-549791 | 5/2010 |
| NL | 47467 | 7/1939 |
| WO | WO 88/02809 | 4/1988 |

* cited by examiner

*Primary Examiner* — Marguerite McMahon
*Assistant Examiner* — James Kim
(74) *Attorney, Agent, or Firm* — Klaus J. Bach

(57) ABSTRACT

In an internal combustion engine having several combustion chambers formed in in-line cylinders wherein an air/fuel mixture can be combusted and which include a common cylinder head, with discharge passages formed within the cylinder head and extending to a common confluence zone in communication with a discharge manifold, the common confluence zone is delimited on a first side (A) by at least one cylinder head wall and a separate shell element on a second side mounted to the outside of the cylinder head, the shell element being curved funnel-like for conducting the exhaust gas away from the engine.

4 Claims, 2 Drawing Sheets

INTERNAL COMBUSTION ENGINE COMPRISING SEVERAL COMBUSTION CHAMBERS

This is a Continuation-in-Part application of pending International Patent application PCT/EP2008/000799 filed Feb. 1, 2008 and claiming the priority of German patent application 10 2007 007 638.1 filed Feb. 16, 2007.

BACKGROUND OF THE INVENTION

The invention relates to an internal combustion engine with several combustion chambers formed in cylinders, in which an air/fuel mixture can be reacted in a combustion reaction and wherein the combustion chambers are delimited by a joint cylinder head, and an exhaust gas discharge passage is associated with each combustion chamber, and several discharge passages extend into a joint confluence zone in the region of a discharge manifold.

DE 101 41 534 A1 discloses a cylinder head for an internal combustion engine having several cylinders, in which several discharge ducts extend from discharge openings of the combustion chambers. The discharge ducts join to form a confluence zone, which is essentially completely integrated into the cylinder head and is delimited by cooling water passages arranged above and below the discharge duct. A mounting surface for a catalytic converter is provided at a flange of the cylinder head, which catalytic converter is bolted directly to the cylinder head. Such a configuration results in a particularly extensive heat exchange between the cooling water in the cooling water passages and the exhaust gas in the confluence zone, however, an elaborate and complicated cylinder head design results, which can be realized only in an expensive manner.

It is the object of the present invention to provide an exhaust gas manifold with especially simple means, whose heat transfer behavior is also advantageous and which requires relatively little space in the engine compartment of a motor vehicle.

SUMMARY OF THE INVENTION

In an internal combustion engine having several combustion chambers formed in in-line cylinders wherein an air/fuel mixture can be combusted and which include a common cylinder head, with discharge passages formed within the cylinder head and extending to a common confluence zone formed partially in the cylinder head in communication with a discharge manifold, the common confluence zone is delimited on a first side (A) by a recessed cylinder head wall section and a separate shell element on a second side mounted to the outside of the cylinder head over the recessed wall section, the shell element being curved funnel-like for conducting the exhaust gas away from the engine.

On the first side of the joint confluence zone several discharge passages are preferably provided, which are formed as components of the cylinder head especially by casting methods and extend to the common confluence zone. For forming the common confluence zone, a tub-shaped recess is provided on the outer side of the cylinder head, which is delimited by several wall structures of the cylinder head preferably cast in one piece. The tub-shaped recess is closed and sealed to the outside by means of a shell element, so that a space is formed between the recess on the side of the cylinder head and the shell element, in which several exhaust gas flows can be joined and diverted. This space is thus formed partially Within the cylinder head and partially outside the cylinder head.

In one arrangement of the invention, a mounting flange for the sealed mounting of the shell element at the cylinder head on the one hand, and a discharge opening with a pipe flange for mounting an exhaust gas pipe or an exhaust gas cleaning unit are provided, wherein the mounting flange and the pipe flange have different dimensions. The essentially annular mounting flange defines a planar or curved separation plane between the cylinder head and the shell element, wherein the separation plane extends through the confluence zone or the space and divides it geometrically. The pipe flange is designed smaller than the mounting flange with regard to a geometric dimension, especially with regard to a maximum transverse extension and/or its diameter and/or the cross section which can accommodate the exhaust gas flow.

The invention will become more readily apparent from the following description of a preferred, embodiment of the invention while referring to the enclosed drawings.

DESCRIPTION OF A PARTICULAR EMBODIMENT

Figure 1:
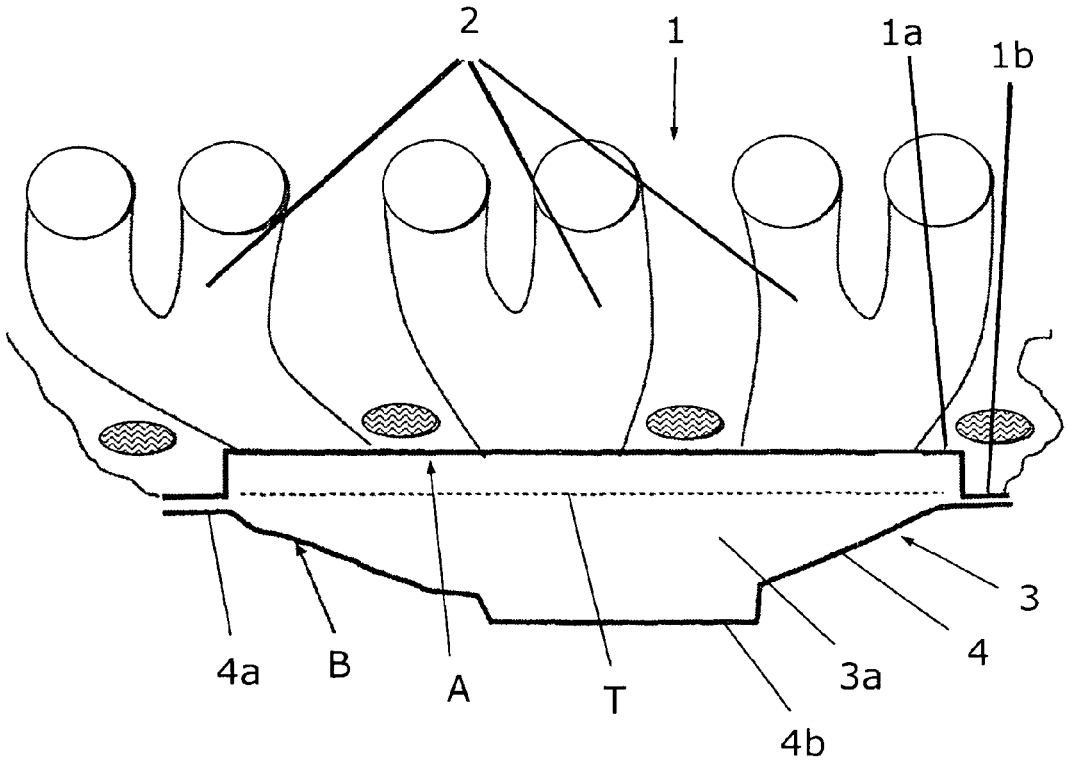
FIG. 1 is a sectional view of a cylinder head of an internal combustion engine according to the invention with an exhaust gas manifold shown in a schematic manner and FIG. 2: a perspective view of the cylinder head.
Figure 2:
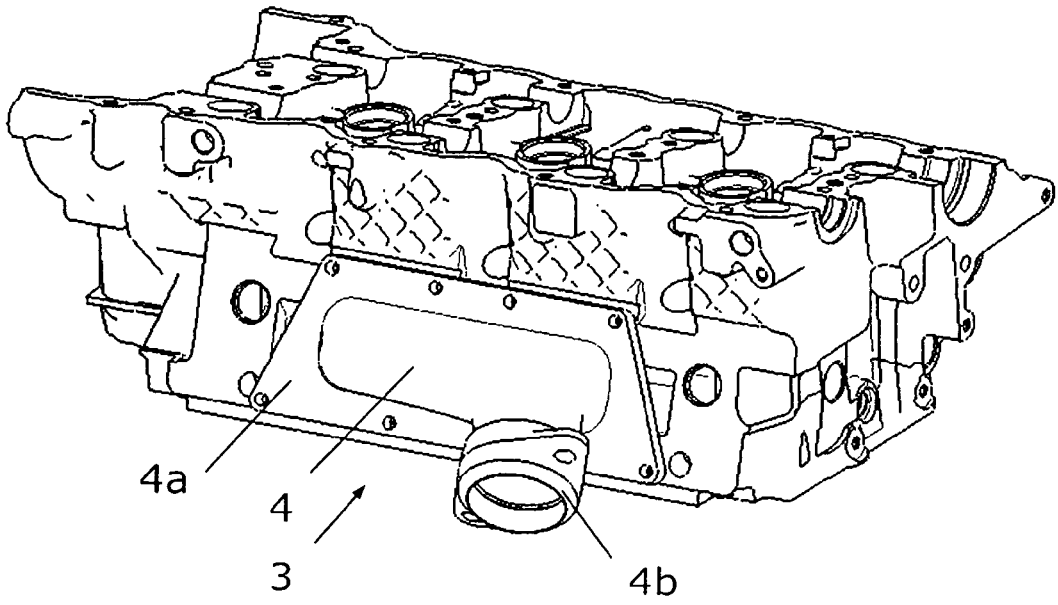

FIG. 1 shows a horizontal section of a cylinder head bank of an internal combustion engine according to the invention, which has six cylinders in two separate cylinder banks arranged in a V-shaped manner, in which an air/fuel mixture can be combusted while generating pressure and heat. The combustion can be carried out according to the diesel method, the Otto method, or a similar combustion method. Each bank has three cylinders including three combustion chambers which are delimited by a common cylinder head 1, preferably manufactured as an single piece by a casting method. Two discharge passages 2 formed in the cylinder head 1 are associated with each combustion chamber, and can be closed by exhaust valves, not shown, in a manner known per se. The discharge passages 2 are designed in a curved manner in the direction toward the exhaust gas duct downstream in a known manner and are positioned close to a cylinder head screw connection and/or close to lubricating oil return bores.

The described six discharge passages 2 of a cylinder bank are associated with a common confluence zone 3*a* in the region of the discharge manifold 3, in which the exhaust gas flows guided through the discharge passages 2 are joined. The joint confluence zone 3*a* is limited by a wall 1*a* of the cylinder head 1 on a first side A of the cylinder head. The wall 1*a* of the cylinder head is essentially tub-shaped or cup-shaped and is surrounded by an annular mounting surface 1*b*. The discharge passages 2 are formed within the cylinder head wall 1*a*, and are arranged in a recessed manner starting from a non-annular separation surface to be defined along the annular mounting surface 1*b*.

The confluence zone 3*a* is delimited by a separate shell element 4 mounted to the cylinder head side wall on a second side B, which delimits the confluence zone 3*a* towards the outside and forms a component of the discharge manifold 3. The shell element 4 is preferably constructed of a temperature-resistant metal sheet, especially sheet steel, or it is a metal casting part and is curved like a funnel and/or a tub in at least some sections. Its simple form enables an especially simple and economic production of the shell element. In a modified embodiment, the shell element comprises a circumferential annular groove which engages the cylinder head in the region of the tub-shaped mounting surface. In a further modified embodiment, the shell element is formed in a double-walled manner. In again a further modified embodiment, the outer exhaust passages 2 in the cylinder head 1 are inclined toward the center of the recessed wall area 1*a* as shown in FIG. 1 so that the recessed wall area 1*a* of the cylinder head is relatively small and the shell element 4 is also comparatively small, whereby the sealing between the cylinder head and the shell element is facilitated.

The shell element 4 has a mounting flange 4*a* for the mounting by means of screws. The mounting flange is designed abutting the mounting surface 1*b*. Thus, one or several preferably annular sealing elements can be used between the mounting surface 1*b* and the mounting flange 4*a*, which are disposed in a separation plane T.

A pipe flange 4*b* is provided at the shell element 4 spaced from the separation plane T and spaced from the cylinder head 1, the flow cross section of which is different with regard to essential geometric dimensions in comparison with the mounting flange 4*a*. The pipe flange has preferably an essentially annular flow cross section, so that a cylindrical pipe element can be directly mounted thereto. The pipe element may be a part of an exhaust gas pipe line and/or of an exhaust gas cleaning unit (catalytic converter, filter or the like).

The tub-shaped recess is closed towards the outside by means of the shell element 4, so that a space is formed between the recess on the side of the cylinder head 1 and the shell element 4, in which several exhaust gas flows are joined, diverted and conducted to a downstream exhaust gas system. This space is thus formed partially within the cylinder head (side A) and partially outside the cylinder head (side B), whereby an especially simple and economically realizable assembly of two approximately vertically divided halves is obtained. On the other hand, by means of constructive measures, e.g. the dimensioning of the form and depth of the shell element and the corresponding recess on the side of the cylinder head 1, a certain desired heat transfer behavior can be obtained. For example, during a cold start of the internal combustion engine, heat transfer to the cooling water, can be reduced in comparison with an embodiment wherein the exhaust gas manifold fully integrated in the cylinder head, so that a faster heating of downstream connected exhaust gas cleaning units is achieved.

What is claimed is:

1. An internal combustion engine including several in-line cylinders with a common cylinder head (1), each cylinder having a combustion chamber with at least one exhaust gas discharge passage (2) extending within the cylinder head (1), the cylinder head (1) including a side wall (1*b*) having an elongate tub-shaped recess formed therein with a flat bottom wall (1*a*) to which the exhaust gas discharge passages (2) extend, and a shell element (4) with a mounting flange (4*a*) mounted onto the cylinder head side wall (1*b*) so as to cover the elongate tub-shaped recess and being curved outwardly to form between the flat bottom wall (1*a*) and the shell element (4) an exhaust gas confluence zone (3*a*) from which the exhaust gas is discharged via an exhaust opening with an exhaust pipe flange (4*b*) formed on the shell element (4).

2. The internal combustion engine according to claim 1, wherein the shell element (4) consists of one of a temperature-resistant sheet metal and a metal casting part.

3. The internal combustion engine according to claim 1, wherein the shell element (4) is a double-walled structure.

4. The internal combustion engine according to claim 1, wherein the outer exhaust passages in the cylinder head are inclined toward the center of the recessed bottom wall (1*a*) whereby the size of the recessed bottom wall including an annular mounting and seal surface of the side wall 1*b* and the shell element (4) and its a mounting flange (4*a*) are relatively small.

* * * * *